US011767146B2

(12) United States Patent
Melinger

(10) Patent No.: US 11,767,146 B2
(45) Date of Patent: Sep. 26, 2023

(54) CONTAINER AND CONTAINER BLANKS WITH INTEGRAL RETRACTABLE POURING SPOUT

(71) Applicant: Great Stuff Design Ltd., Kfar Saba (IL)

(72) Inventor: Tal Claire Melinger, Kfar Saba (IL)

(73) Assignee: GREAT STUFF DESIGN LTD., Kfar Saba (IL)

( * ) Notice: Subject to any disclaimer, the term of this patent is extended or adjusted under 35 U.S.C. 154(b) by 0 days.

(21) Appl. No.: 18/185,939

(22) Filed: Mar. 17, 2023

(65) Prior Publication Data

US 2023/0227204 A1 Jul. 20, 2023

Related U.S. Application Data

(63) Continuation of application No. PCT/IB2021/058804, filed on Sep. 27, 2021.

(60) Provisional application No. 63/084,882, filed on Sep. 29, 2020.

(51) Int. Cl.

| | |
|---|---|
| ***B65D 5/74*** | (2006.01) |
| ***B65D 5/56*** | (2006.01) |
| ***B65D 5/42*** | (2006.01) |
| ***B65D 5/18*** | (2006.01) |

(52) U.S. Cl.

CPC ..... *B65D 5/743* (2013.01); *B65D 5/18* (2013.01); *B65D 5/4204* (2013.01); *B65D 5/563* (2013.01)

(58) Field of Classification Search

CPC ..... B65D 5/743; B65D 5/18; B65D 5/4204; B65D 5/563; B65D 5/74; B65D 5/02; B65D 5/70; B65D 5/06; B65D 5/40; B65D 5/42

USPC ..... 222/572, 574, 212; 229/215, 125.42

See application file for complete search history.

(56) References Cited

U.S. PATENT DOCUMENTS

| | | | | | |
|---|---|---|---|---|---|
| 2,338,260 | A * | 1/1944 | Ringler | B65D 5/743 | 229/215 |
| 2,475,677 | A * | 7/1949 | Ringler | B65D 5/743 | 229/215 |
| 2,509,289 | A | 5/1950 | Dunning | | |
| 2,818,207 | A * | 12/1957 | Wilson | B65D 5/743 | 229/125.42 |

(Continued)

FOREIGN PATENT DOCUMENTS

| | | | |
|---|---|---|---|
| WO | 2011084074 | A1 | 7/2011 |

OTHER PUBLICATIONS

International Search Report for PCT Application No. PCT/IB2021/058804 dated Nov. 29, 2021. The International Bureau of WIPO.

(Continued)

*Primary Examiner* — Charles P. Cheyney

(74) *Attorney, Agent, or Firm* — M&B IP Analysts, LLC

(57) ABSTRACT

A container, formed from a container blank, for containing therein a dispensable material of variety of form, has a plurality of panels. A first panel has severance lines that upon application of pressure disengage to create an integral spout for dispensing of the material. Opening and closing of the container is each via easy application of minimal force causing the spout to open or close as needed. The initial opening of the spout severs the severance lines that form the spout. Thereafter the spout may be open or closed upon proper application of pressure around folding lines of the container.

23 Claims, 7 Drawing Sheets

(56) References Cited

U.S. PATENT DOCUMENTS 2,842,302 A * 7/1958 Ryder ..... B65D 5/743 229/215
3,057,531 A * 10/1962 Preen ..... B65D 5/74 229/125.42
3,262,627 A * 7/1966 Kersh ..... B65D 5/743 229/218
3,269,644 A * 8/1966 Bump ..... B65D 5/742 222/572
3,315,866 A * 4/1967 Kersh ..... B65D 5/743 229/218
3,692,227 A * 9/1972 Hennessey ..... B65D 5/743 229/215
3,957,180 A * 5/1976 Skillman ..... B65D 5/065 229/216
4,228,899 A * 10/1980 Austin, Jr. ..... B65D 5/705 229/215
4,356,951 A * 11/1982 Sharp ..... B65D 5/744 229/125.42
4,657,174 A * 4/1987 Hennig ..... B65D 5/745 229/215
5,332,130 A * 7/1994 Spronk ..... B65D 5/743 229/122
5,494,216 A * 2/1996 Van Suntenmaartensdijk ..... B65D 5/743 229/210
5,680,986 A * 10/1997 Botterman ..... B65D 5/744 229/207
5,820,017 A * 10/1998 Eliovson ..... B65D 77/064 229/219
5,857,614 A 1/1999 Walsh
6,050,484 A 4/2000 Galomb
6,062,467 A 5/2000 Ours et al.
6,419,151 B1 7/2002 Urtubey
7,036,714 B2 5/2006 Walsh et al.
7,210,612 B2 5/2007 Walsh et al.
7,913,897 B2 3/2011 Manaige
7,971,773 B2 7/2011 Wagner et al.
9,108,761 B2 8/2015 Fitzwater et al.
9,156,579 B2 10/2015 Pinkstone
9,701,438 B2 7/2017 Fitzwater et al.
10,022,943 B2 * 7/2018 Scharfenort ..... B65D 5/4266
10,479,549 B2 11/2019 Kearns
10,501,227 B2 12/2019 Fitzwater et al.
2006/0054675 A1 * 3/2006 Bennett ..... B65D 5/743 229/215
2006/0255109 A1 11/2006 Green
2007/0181657 A1 * 8/2007 Barthel ..... B65D 5/743 229/215
2010/0102114 A1 * 4/2010 Pinkstone ..... B65D 5/745 229/218
2010/0282829 A1 * 11/2010 Jackson ..... B65D 3/261 229/125.42
2012/0043321 A1 2/2012 Brink et al.

OTHER PUBLICATIONS

Written Opinion of the Searching Authority for PCT Application No. PCT/IB2021/058804 dated Nov. 29, 2021. The International Bureau of WIPO.

* cited by examiner

CONTAINER AND CONTAINER BLANKS WITH INTEGRAL RETRACTABLE POURING SPOUT

CROSS-REFERENCE TO RELATED APPLICATIONS

This application is a continuation of International Application No. PCT/162021/058804, filed on Sep. 27, 2021, which claims the benefit of U.S. Provisional Application No. 63/084,882 filed on Sep. 29, 2020, the contents of which are hereby incorporated by reference.

TECHNICAL FIELD

The disclosure generally relates to a container, more particularly to container shaped from a blank by folding the blank into a desired shape, and even more particularly to a container formed from a blank that comprises an integral retractable pouring spout.

BACKGROUND

Paperboard cartons for containing pourable material such as dry food items are known. Often the cartons contain an additional plastic bag to store dry food such as grains. Cartons may be difficult to open and close. Once opened sometimes the closure is neither neat nor easy. Many cartons do not include an integral spout and provide no way of dispensing materials easily. Some cartons have an integral spout that is made from a different material. Even cartons that do include an integral spout or dispenser do not close neatly or pour efficiently. Notably, while containers made of carton are one possible material to create such containers, other containers are possible that are formed from a blank and then folded into the desired container shape.

U.S. Pat. No. 2,475,677 (the '677 Patent) describes a container with re-closable integral pouring spout whereby the spout is formed by applying pressure the side panels of the carton. A deficiency of this method for opening the spout is that constant repeated pressure on the sides of the carton and displacement of the adjacent walls will weaken the side panels and reduce the stability and structure. In addition, in order to maintain a pouring spout, the user is required to apply constant pressure on the adjacent walls which may be bothersome to some and is not ideal for young or elderly users.

Similarly, US Patent Application No. 2006/0054675 (the '675 Patent Application) also discloses a container with an integral pouring spout that opens a depression of adjacent sides of the container. Only by way of cessation of depression of the sides of the container does the pour spout close and the container return to its original form. As with the '677 Patent, this means that over time the structure of the container may loosen and there is an element of lack of control when the user pours because of the requirement to maintain pressure on the sides of the container.

In view of the deficiencies of the prior art there is a need to provide a container that overcomes the deficiencies of the prior art.

SUMMARY

A summary of several example embodiments of the disclosure follows. This summary is provided for the convenience of the reader to provide a basic understanding of such embodiments and does not wholly define the breadth of the disclosure. This summary is not an extensive overview of all contemplated embodiments, and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "some embodiments" or "certain embodiments" may be used herein to refer to a single embodiment or multiple embodiments of the disclosure.

Certain embodiment disclosed herein include a container with an integrated pouring spout that stores a material therein, comprising: a top panel having a plurality of sides, a plurality of first folding lines that meet at a top intersection point, a plurality of corners, and a second folding line that perpendicularly extends from a first side of the plurality of sides to the top intersection point, wherein each of the plurality of first folding lines starts at a respective corner of the plurality of corners and extends towards the top intersection point; a front panel extending downwards from the first side of the plurality of sides of the top panel, the front panel having a third folding line, a fourth folding line, a fifth folding line, a sixth folding line, a seventh folding line, an eighth folding line, a ninth folding line, a first severance line, and a second severance line; and a plurality of side panels, each of the plurality of side panels extending from one of the plurality of sides of the top panel other than the first side of the plurality of sides of the top panel such that, together with the top panel and the front panel, the plurality of side panels collectively form the container; wherein the third folding line of the front panel extends from a meeting point of the second folding line with the first side of the plurality of sides of the top panel to a first point of the front panel that is away from a second side of the front panel which is opposite to the first side of the plurality of sides of the top panel; wherein the fourth folding line of the front panel extends from a first edge of the second side of the front panel to the first point of the front panel; wherein the fifth folding line of the front panel extends from a second edge of the second side of the front panel to the first point of the front panel; wherein the first severance line of the front panel extends from a second point that is between the first point and the meeting point of the second folding line with the first side of the plurality of sides of the top panel, the first severance line extending at an upward angle towards a third side of the front panel that extends between the first side of the plurality of sides of the top panel and the second side of the front panel to a third point that is on the front panel and not on the third side; wherein the second severance line of the front panel extends from the second point, the second severance line extending at an upward angle towards a fourth side of the front panel that extends between the first side of the plurality of sides of the top panel and the second side of the front panel to a fourth point that is on the front panel and not on the fourth side; wherein the sixth folding line of the front panel extends from the first point on the front panel to the third point; wherein the seventh folding line of the front panel extends from the first point on the front panel to the fourth point; wherein the eighth folding line of the front panel extends from the third point to a first proximal edge of the first side of the plurality of sides of the top panel; and wherein the ninth folding line of the front panel extends from the fourth point to a second proximal edge of the first side of the plurality of sides of the top panel; and wherein a deltoid shape confined within the first severance line, the second severance line, the sixth folding line of the front panel, and the seventh folding line of the front panel forms an integrated pouring spout of the container.

Certain embodiment disclosed herein include a blank for a container that includes an integrated pouring spout that stores a material therein, comprising: a top panel having a plurality of sides, a plurality of first folding lines that meet at a top intersection point, a plurality of corners, and a second folding line that perpendicularly extends from a first side of the plurality of sides to the top intersection point, wherein each of the plurality of first folding lines starts at a respective corner of the plurality of corners and extends towards the top intersection point; and a front panel extending downwards from the first side of the plurality of sides of the top panel, the front panel having a third folding line, a fourth folding line, a fifth folding line, a sixth folding line, a seventh folding line, an eighth folding line, a ninth folding line, a first severance line, and a second severance line; wherein the third folding line of the front panel extends from a meeting point of the second folding line with the first side of the plurality of sides of the top panel to a first point of the front panel that is away from a second side of the front panel which is opposite to the first side of the plurality of sides of the top panel; wherein the fourth folding line of the front panel extends from a first edge of the second side of the front panel to the first point of the front panel; wherein the fifth folding line of the front panel extends from a second edge of the second side of the front panel to the first point of the front panel; wherein the first severance line of the front panel extends from a second point that is between the first point and the meeting point of the second folding line with the first side of the plurality of sides of the top panel, the first severance line extending at an upward angle towards a third side of the front panel that extends between the first side of the plurality of sides of the top panel and the second side of the front panel to a third point that is on the front panel and not on the third side; wherein the second severance line of the front panel extends from the second point, the second severance line extending at an upward angle towards a fourth side of the front panel that extends between the first side of the plurality of sides of the top panel and the second side of the front panel to a fourth point that is on the front panel and not of the fourth side; wherein the sixth folding line extends from the first point on the front panel to the third point; wherein the seventh folding line extends from the first point on the front panel to the fourth point; wherein the eighth folding line extends from the third point to a first proximal edge of the first side of the plurality of sides of the top panel; wherein the ninth folding line extends from the fourth point to a second proximal edge of the first side of the plurality of sides of the top panel; and wherein a deltoid shape confined within the first severance line, the second severance line, the sixth folding line of the front panel, and the seventh folding line of the front panel forms the integrated pouring spout of the container.

BRIEF DESCRIPTION OF THE DRAWINGS

The subject matter of the disclosure is particularly pointed out and distinctly claimed in the claims at the conclusion of the specification. The foregoing and other objects, features and advantages will become apparent and more readily appreciated from the following detailed description taken in conjunction with the accompanying drawings.

DETAILED DESCRIPTION

Figure 1:
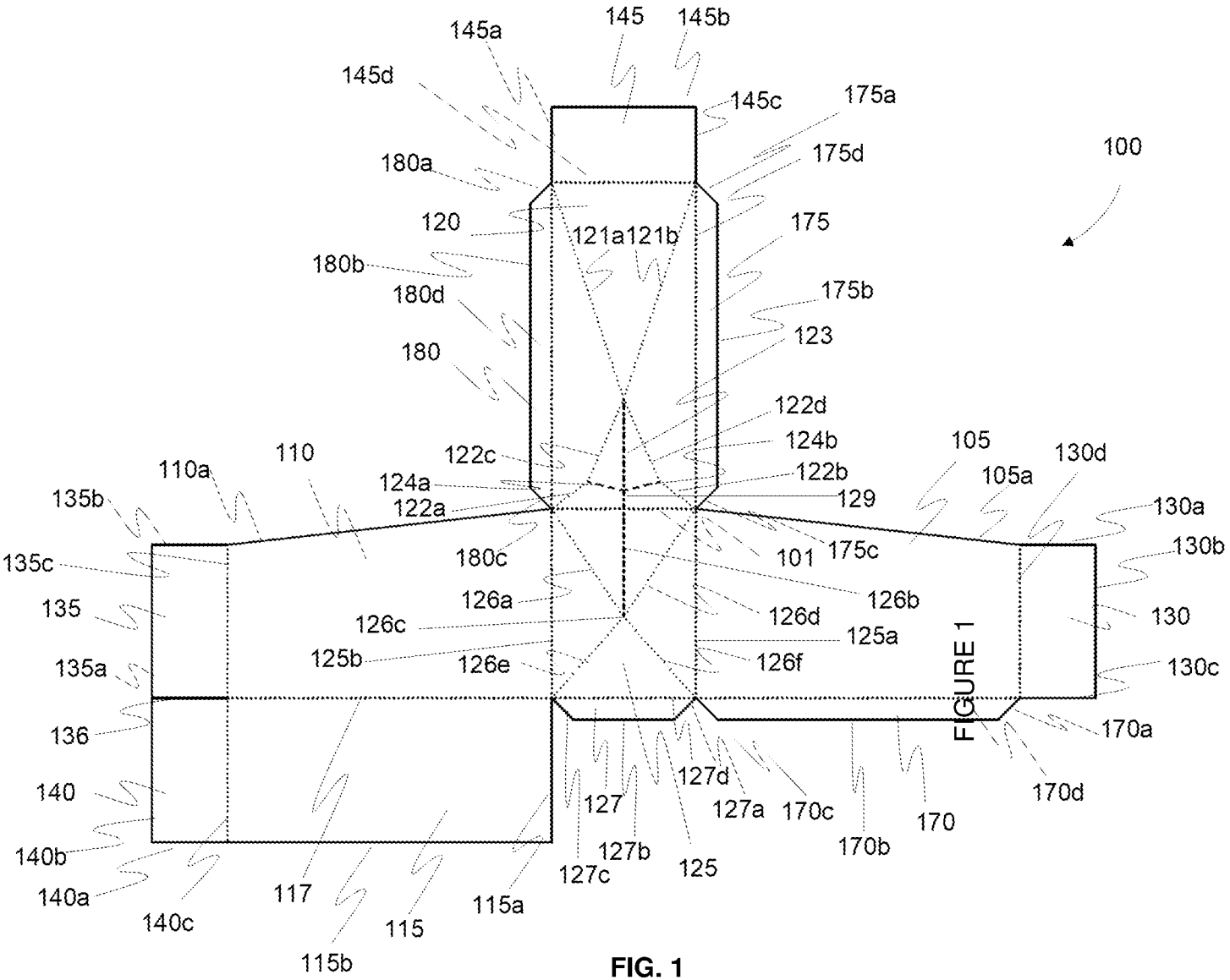
FIG. 1 is a plan view of a blank of a container with a retractable pouring spout according to an embodiment.

It is important to note that the embodiments disclosed herein are only examples of the many advantageous uses of the innovative teachings herein. In general, statements made in the specification of the present application do not necessarily limit any of the various claimed embodiments. Moreover, some statements may apply to some inventive features but not to others. In general, unless otherwise indicated, singular elements may be in plural and vice versa with no loss of generality. In the drawings, like numerals refer to like parts through several views.

A container, formed from a container blank, for containing therein a dispensable material of variety of form, has a plurality of panels. A first panel has severance lines that upon application of pressure disengage to create an integral spout for dispensing of the material. Opening and closing of the container is each via easy application of minimal force causing the spout to open or close as needed. The initial opening of the spout severs the severance lines that form the spout. Thereafter the spout may be open or closed upon proper application of pressure around folding lines of the container.

FIG. 1 is an example plan view 100 of a blank of a container having a retractable pouring spout implemented according to an embodiment. In FIG. 1, as well as other relevant figures, a solid line indicates a cutting or die-cut line of the blank. Lines 105*a*, 130*a*, 130*b*, 130*c*, 170*a*, 170*b*, 170*c*, 127*a*, 127*b*, 127*c*, 115*a*, 115*b*, 140*a*, 140*b*, 136, 135*a*, 135*b*, 110*a*, 180*a*, 180*b*, 180*c*, 145*a*, 145*b*, 145*c*, 175*a*, 175*b* and 175*c* are die-cut lines. A bold dotted line denotes a first type of folding line which forms the container itself. The first type of folding lines that form the container are lines 145*d*, 175*d*, 130*d*, 170*d*, 127*d*, 117, 180*d*, 101, 125*a* and 125*b*. A dotted line denotes a third type of folding line which folds in a convex manner. The third type of folding lines are 121*a*, 121*b*, 122*a*, 122*b*, 122*c*, 122*d*, 123, 126*a*, 126*d*, 126*e* and 126*f*. A dot-dash line denotes a fourth type of folding line which folds in a concave manner. The fourth type of folding lines are 126*b* and 129. The third and fourth types of folding lines (concave and convex respectively) refer to the direction of the fold of parts of the container when the mechanism of the spout is in operation. Concave being inwardly and convex being outwardly with respect to the container. A dashed line denotes a perforation or a separation line. Lines 124*a* and 124*b* are perforation lines.

Each of the side panels 105, 110, 115 and front panel 120 includes a respective bottom end flap 130, 135, 140, 145, foldable connected thereto at respective longitudinal fold lines 130*d*, 135*c*, 140*c*, 145*d*. Flap 130 is cut from blank 100 at die-cut lines 130*a*, 130*b* and, 130*c*. Flap 135 is cut from blank 100 at die-cut lines 135*a* and 135*b*. Flap 140 is cut from blank 100 at die-cut lines 140*a* and 140*b* and flap 145 is cut from blank 100 at die-cut line 145*a*, 145*b* and 145*c*. An adhesive panel (not shown) may be added to one or more of the flaps 130, 135, 140 and 145. Flaps 135 and 140 are separated by die-cut line 136. The blank of the container may be made from a plurality of different materials that are foldable and connectable for the purpose of forming the container described herein. This includes, but not by way of limitation, a laminar material such as cardboard. Similarly, side panel 105 includes respective side end wing 170 foldable connected thereto at longitudinal fold line 170*d* and cut from blank 100 at die cut lines 170*a*, 170*b* and 170*c*. Front panel 120 includes respective side end wing and 175 and 180 foldable connected thereto at respective longitudinal fold lines 175*d* and 180*d* and cut from blank 100 at die-cut lines 175*a*, 175*b*, 175*c* 180*a*, 180*b* and 180*c*. Top panel 125 includes respective side wing 127 foldable connected thereto by longitudinal fold line 127*d* and cut from blank 100 at die-cut lines 127*a*, 127*b*, and 127*c*. An adhesive panel (not shown) may be added to wings 170, 175 and 180.

Top panel 125 includes folding lines 125*a*, 125*b*, 126*a*, 126*b*, 126*d*, 126*e* and 126*f*. Folding lines 125*a* and 125*b* (along with 101 and 127*d*) form the container. Folding lines 126*a* and 126*d* 126*e* and 126*f* intersect at top intersection point 126*c* creating two triangles (not necessarily of the same size) but that have at least two sides that are equal in length. The other two triangles have different size sides. Folding line 126*b* dissects the front triangle created by folding lines 126*a* and 126*d*. Fold lines 126*a*, 126*d*, 126*e*, and 126*f* fold in a convex manner. Fold line 126*b* folds in a concave manner. Top panel 125 includes respective side wing 127 foldable connected thereto at longitudinal fold line 127*d*. An adhesive panel (not shown) may be added to wing 127. Side panels 110 and 105 may be foldable connected to side panel 115 and front panel 120 to form a cuboid shaped container. The front panel 120 may be foldable and may be connected to top panel 125 at the first side 101. Side panel 110 is foldable connected to bottom panel 115 via longitudinal fold line 117. Adhesive panel (not shown) may be added to any of, but not limited, to flaps 130, 135, 140, 145 to adhere all panels when forming the cuboid container.

Front panel 120 includes folding lines 101, 145*d*, 175*d*, 180*d*, which form the container shape, folding lines 121*a*, 121*b*, 122*a*, 122*b*, 122*c*, 122*d*, 123, which fold in a convex manner, 129 which folds in a concave manner, and severance lines 124*a* and 124*b* which form the shape of the integral pour spout when pressure is applied long folding line 101. The deltoid shaped pour spout is defined by lateral folding line 123 and severance lines 124*a* and 124*b* on each side. Severance lines 124*a* and 124*b* may be perforated by initially applying pressure upon the material, severing it, and opening the container. Severance lines 124*a* and 124*b* may be perforated or just designed to be weaker at the spot (for example thinner or partly cut).

Figure 2A:
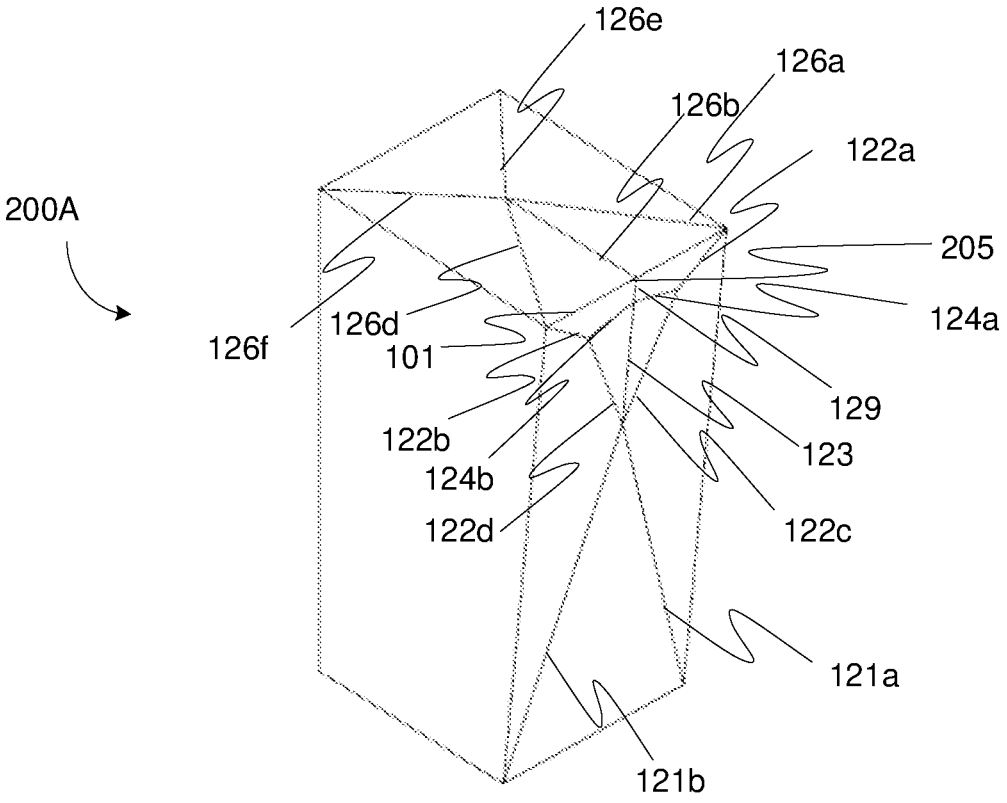
FIG. 2A is a top side perspective view of the container formed from the blank shown in FIG. 1 according to an embodiment.

FIG. 2A is an example top side perspective view of a cuboid shaped container 200A formed from the blank 100 shown in FIG. 1 with the pouring spout in closed position according to an embodiment. In the closed position, folding lines and severance lines, 121*a*, 121*b*, 122*a*, 122*b*, 122*c*, 122*d*, 123, 124*a*, 124*b*, 126*a*, 126*b*, 126*d*, 126*e*, 126*f* and 129, are flush with the cuboid container. To open the container, a small amount of pressure may be applied to point 205 causing the cuboid shape to transform into the illustration shown in FIG. 2B. When the container is first opened the severance lines 124*a* and 124*b* will sever and therefore open the container as intended.

Figure 2B:
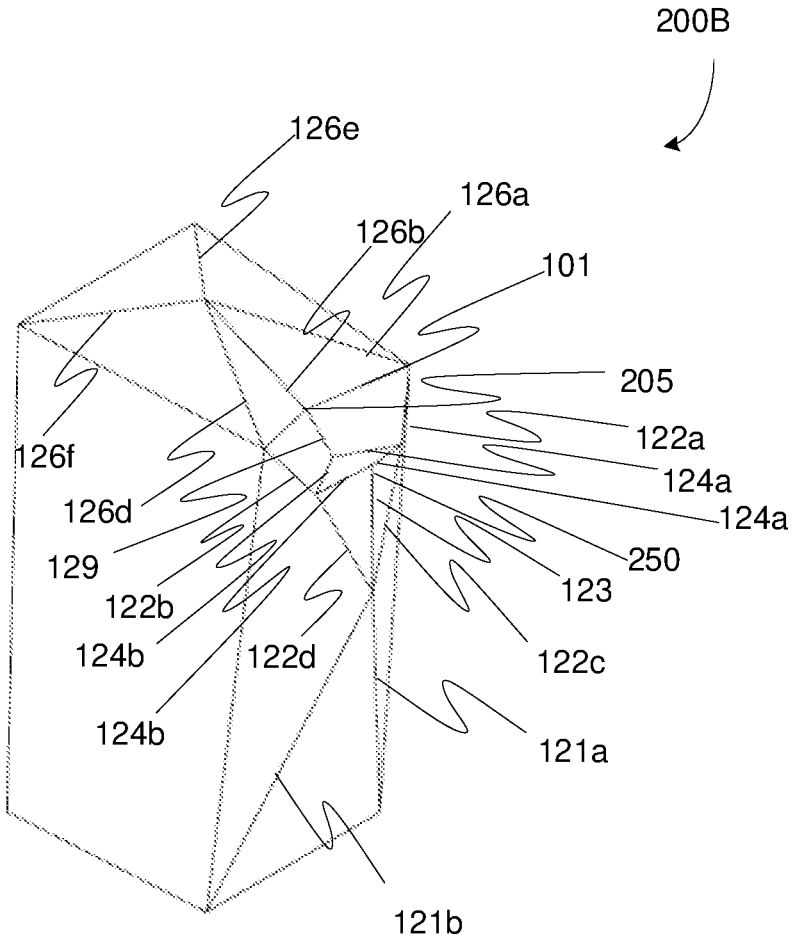
FIG. 2B is a top side perspective view of the container formed from the blank shown in FIG. 1 with the pouring spout in open position implemented according to an embodiment.

FIG. 2B is an example top side perspective view of the container 200B formed from the blank 100 shown in FIG. 1 with the pouring spout in open position according to an embodiment. Following pressure being applied to point 205 shown in FIG. 2A, folding lines 126*b*, 129 and 101 will fall inwards in a concave position simultaneously pushing folding lines 121*a*, 121*b*, 122*a*, 122*b*, 122*c*, 122*d*, 123, 126*a*, 126*d*, 126*e*, and 126*f* upwards to a convex position. Severance lines 124*a* and 124*b* (FIG. 2A) are either severed or opened and in a concave and convex position to form a spout. Thus, a retractable deltoid shaped (or kite geometry) pouring spout is formed by folding lines 122*c* and 122*d*, lateral fold line 123, and severance lines 124*a* and 124*b*. The pouring spout is defined by lateral folding line 123. In order to reclose the container and retract the spout a small amount of pressure is applied to point 250 at the tip of the spout causing all folding lines to return to flush position shown in FIG. 2A. Alternatively a pressure may be applied at the top intersection point 126*c* (see FIG. 1 for reference), and further alternatively, simultaneously at both point 250 and at the top intersection point 126*c*.

Figure 3A:
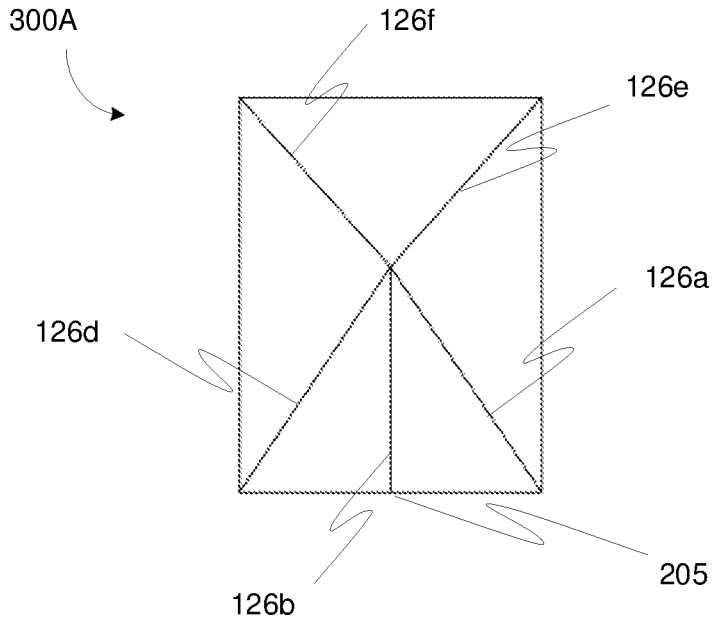
FIG. 3A is a top perspective view of a container formed from the blank shown in FIG. 1 with the pouring spout in closed position implemented according to an embodiment.

FIG. 3A is an example top perspective view of a cuboid shaped container formed 300A from the blank 100 shown in FIG. 1 with the pouring spout in closed position according to an embodiment. In this position the folding lines 126*a*, 126*b*, 126*d*, 126*e* and 126*f* are flush with the cuboid shaped container. In order to open the container a small amount of inward pressure may be applied at point 205 and the cuboid shape will transform to the illustration in FIG. 3B.

Figure 3B:
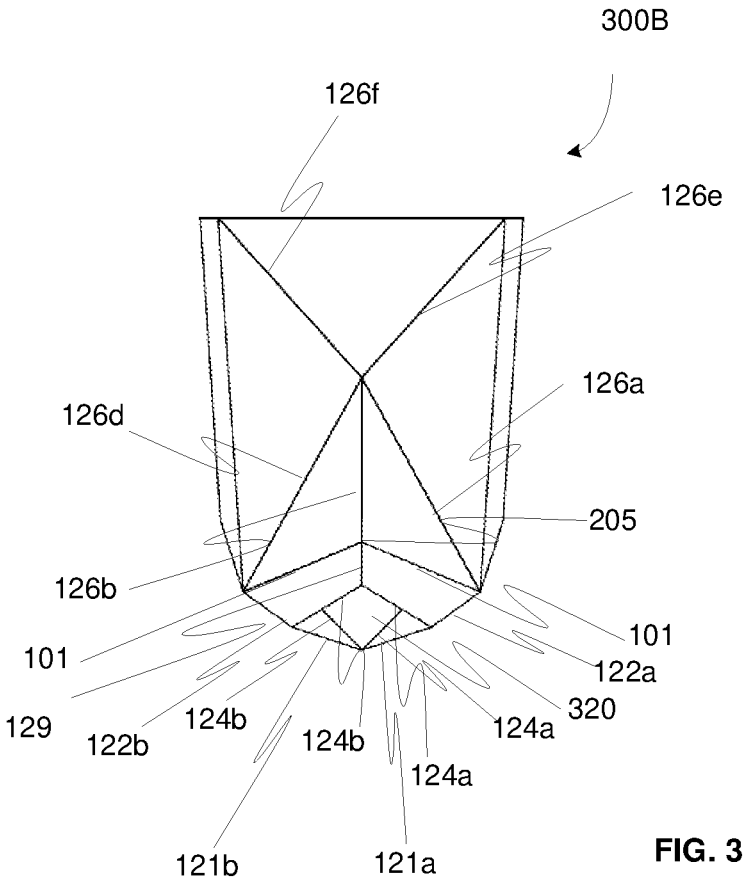
FIG. 3B is a top perspective view of the container formed from the blank shown in FIG. 1 with the pouring spout in open position implemented according to an embodiment.

FIG. 3B is an example top perspective view of the container 300B formed from the blank 100 shown in FIG. 1 with the pouring spout in an open position according to an embodiment. Following inward pressure being applied to point 205 shown in FIG. 3A, folding line 101, 126*b* and 129, will fall inwards in a concave position, simultaneously pushing folding lines 122*a*, 122*b*, 126*a*, 126*d*, 126*e*, 126*f*, 121*a* and 121*b* upwards to a convex position. Severance lines 124*a* and 124*b* (see FIG. 2A) are either severed or opened and converting into two new lines in both concave and convex position. Thus, the retractable deltoid shaped pouring spout 320 will be formed as severance lines 124*a* and 124*b* fold inwards in a concave position and outward in convex position.

Figure 4:
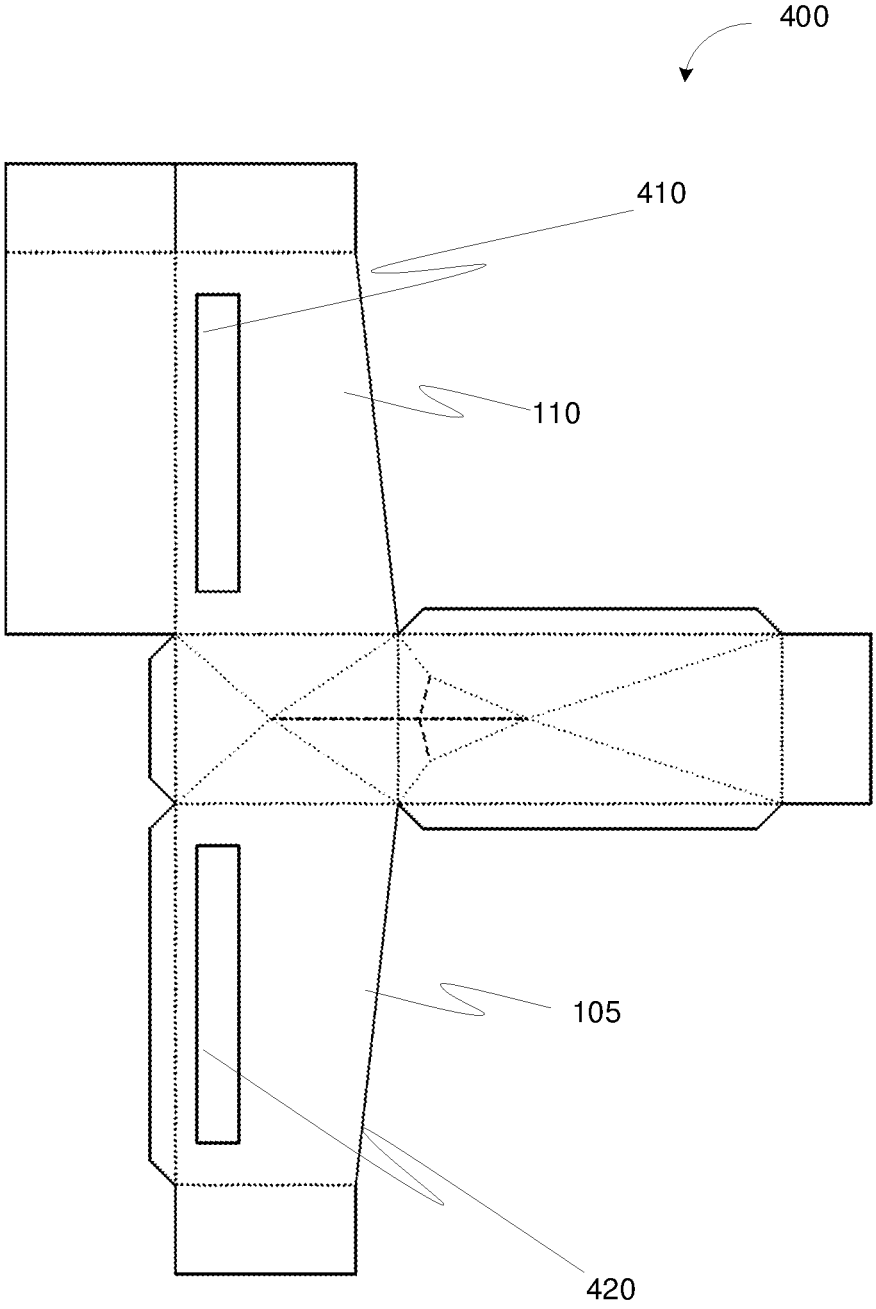
FIG. 4 is a plan view of a blank of a container with a retractable pouring spout and side panel window implemented according to an embodiment.

FIG. 4 is an example plan view 400 of a blank for making the container having a retractable pouring spout and at least a side panel window according to an embodiment. FIG. 4 is an embodiment of FIG. 1 with the addition of at least a side window 410. In this particular embodiment, side panels 105 and 110 include windows 420 and 410 respectively in order to see contents of the container. In an embodiment, the windows 410 and 420 may be further covered with at least a partially transparent film, for example made of plastic, that enable to see into the container once the blank is formed into the shape of the container.

Figure 5A:
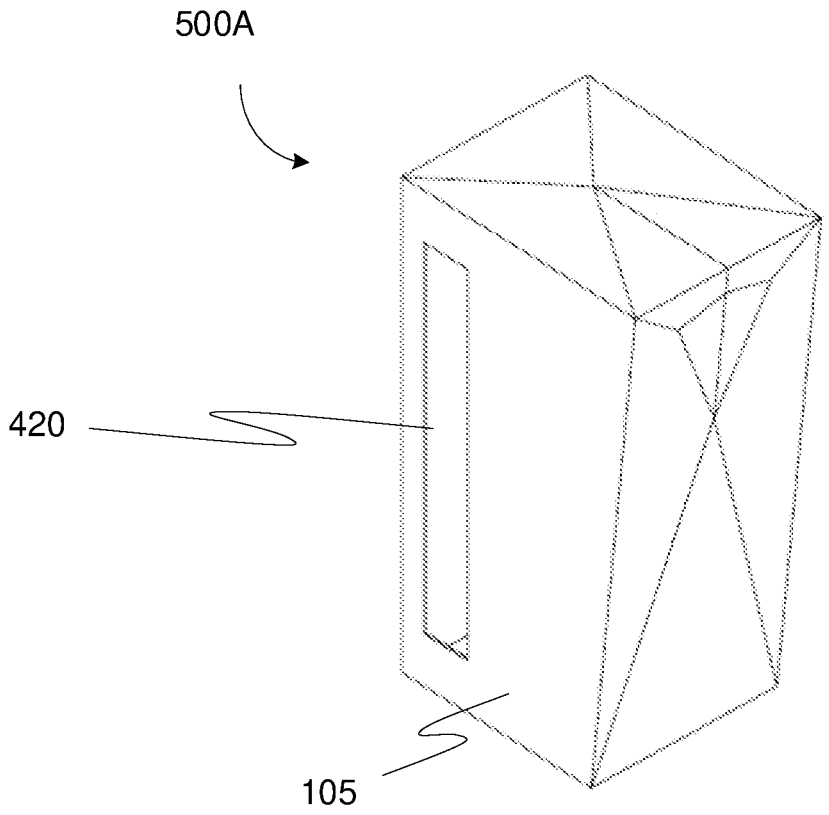
FIG. 5A is a top side perspective view of a container formed from the blank shown in FIG. 4 with side panel window and the pouring spout in closed position implemented according to an embodiment.
Figure 5B:
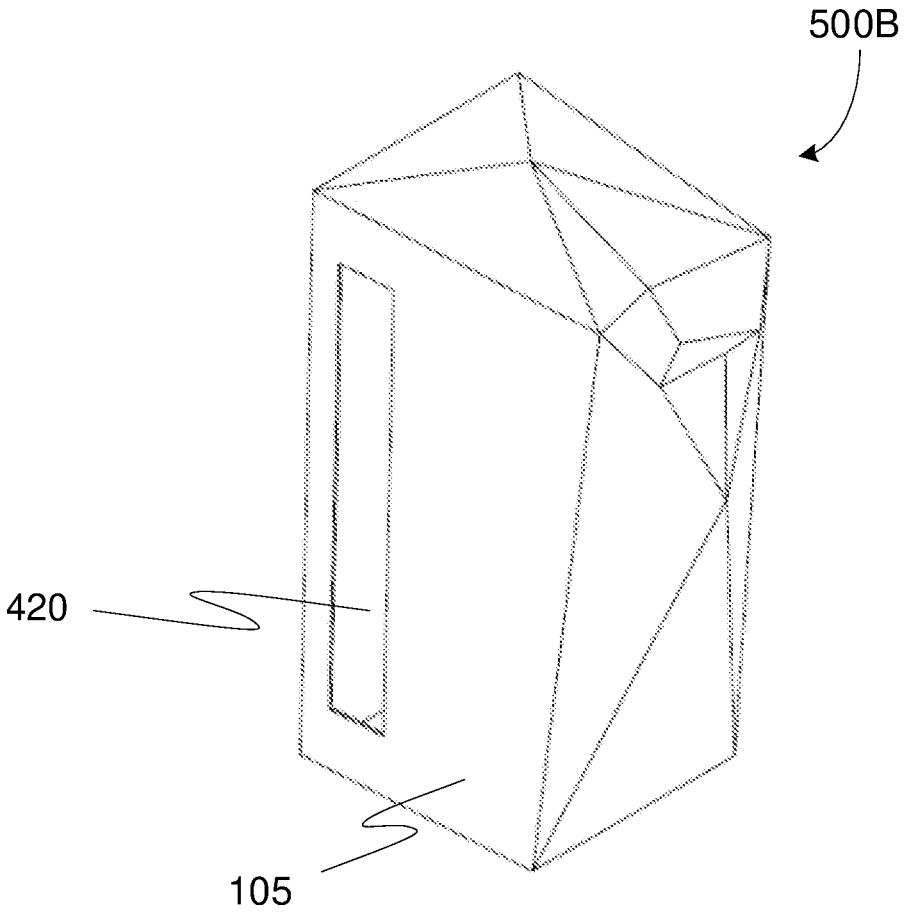
FIG. 5B is top side perspective view of the container formed from the blank shown in FIG. 4 with side panel window and the pouring spout in open position implemented according to an embodiment.

FIG. 5A is an example top perspective view of a cuboid shaped container 500A formed from the blank shown in FIG. 4 with the pouring spout in closed position and window 420 cut out from side panel 105 implemented according to an embodiment. The window 420 allows the user of the container to see its contents. In one embodiment, the window is included on both side panel 105 and opposite side panel 110 (not shown) of the container 500A. In another embodiment, the window is included on only one side of the container. FIG. 5B is an example top perspective view of a cuboid shaped container 500B formed from the blank shown in FIG. 4 with the pouring spout in opened position and window 420 cut out from side panel 105 according to an embodiment. In another embodiment the window is included on only one side of the container. One of ordinary skill in the art would readily appreciate that windows such as window 420 may be placed on other panels of the container 500 without departing from the scope of the invention.

One of ordinary skill in the art would readily appreciate that the containers described herein may be used for storage of different materials therein. These include, but are not limited to, powders, food stuff, liquids, gels, granulated materials, and others. In one embodiment, the inner side of the blank, for example blank 100, is coated with materials that make it non-porous. Furthermore, while the description herein is directed for a six-panel cuboid it should be understood that differently shaped containers having more or less panels may be formed with a retractable spout based upon the principles of the invention and therefore are specifically included herein. Furthermore, the blank 100 may be, in an embodiment, comprise of a porous or non-porous material. In one embodiment the blank 100 may comprise from layers of materials, for example but not by way of limitation, a laminated cardboard.

All examples and conditional language recited herein are intended for pedagogical purposes to aid the reader in understanding the principles of the disclosed embodiment and the concepts contributed by the inventor to furthering the art, and are to be construed as being without limitation to such specifically recited examples and conditions. Moreover, all statements herein reciting principles, aspects, and embodiments of the disclosed embodiments, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. A container with an integrated pouring spout that stores a material therein, comprising:

a top panel having a plurality of sides, a plurality of first folding lines that meet at a top intersection point, a plurality of corners, and a second folding line that perpendicularly extends from a first side of the plurality of sides to the top intersection point, wherein each of the plurality of first folding lines starts at a respective corner of the plurality of corners and extends towards the top intersection point;

a front panel extending downwards from the first side of the plurality of sides of the top panel, the front panel having a third folding line, a fourth folding line, a fifth folding line, a sixth folding line, a seventh folding line, an eighth folding line, a ninth folding line, a first severance line, and a second severance line; and a plurality of side panels, each of the plurality of side panels extending from one of the plurality of sides of the top panel other than the first side of the plurality of sides of the top panel such that, together with the top panel and the front panel, the plurality of side panels collectively form the container;

wherein the third folding line of the front panel extends from a meeting point of the second folding line with the first side of the plurality of sides of the top panel to a first point of the front panel that is away from a second side of the front panel which is opposite to the first side of the plurality of sides of the top panel;

wherein the fourth folding line of the front panel extends from a first edge of the second side of the front panel to the first point of the front panel;

wherein the fifth folding line of the front panel extends from a second edge of the second side of the front panel to the first point of the front panel;

wherein the first severance line of the front panel extends from a second point that is between the first point and the meeting point of the second folding line with the first side of the plurality of sides of the top panel, the first severance line extending at an upward angle towards a third side of the front panel that extends between the first side of the plurality of sides of the top panel and the second side of the front panel to a third point that is on the front panel and not on the third side;

wherein the second severance line of the front panel extends from the second point, the second severance line extending at an upward angle towards a fourth side of the front panel that extends between the first side of the plurality of sides of the top panel and the second side of the front panel to a fourth point that is on the front panel and not on the fourth side;

wherein the sixth folding line of the front panel extends from the first point on the front panel to the third point;

wherein the seventh folding line of the front panel extends from the first point on the front panel to the fourth point;

wherein the eighth folding line of the front panel extends from the third point to a first proximal edge of the first side of the plurality of sides of the top panel; and wherein the ninth folding line of the front panel extends from the fourth point to a second proximal edge of the first side of the plurality of sides of the top panel; and wherein a deltoid shape confined within the first severance line, the second severance line, the sixth folding line of the front panel, and the seventh folding line of the front panel forms an integrated pouring spout of the container.

2. The container of claim 1, wherein the second folding line of the top panel extends from essentially the center of the first side of the plurality of sides of the top panel.

3. The container of claim 1, wherein the third folding line of the front panel is perpendicular to the first side of the plurality of sides of the top panel.

4. The container of claim 1, wherein the container is adapted to contain therein at least one of: liquid, gel, powder, granular solids, and foodstuff.

5. The container of claim 1, wherein application of pressure for the first time at the meeting point causes the first severance line and the second severance line to both sever and outwardly extend to form the integrated pouring spout.

6. The container of claim 5, wherein application of pressure at the second point on the front panel when the integrated spout is extended causes the integrated spout to retract to its original position within the front panel.

7. The container of claim 6, wherein application of pressure at the meeting point causes the integrated pouring spout to extend.

8. The container of claim 1, further comprising:

at least one window, wherein each window is defined in one of the plurality of side panels.

9. The container of claim 8, wherein each window is covered with at least a partially transparent film.

10. The container of claim 1, wherein the container is made of any one of: a porous material and a non-porous material.

11. The container of claim 1, wherein at least one of the panels is laminated.

12. The container of claim 1, further comprising:

a plurality of flaps adapted to form a bottom of the container and extending from each of the plurality of side panels.

13. A blank for a container that includes an integrated pouring spout that stores a material therein, comprising:

a top panel having a plurality of sides, a plurality of first folding lines that meet at a top intersection point, a plurality of corners, and a second folding line that perpendicularly extends from a first side of the plurality of sides to the top intersection point, wherein each of the plurality of first folding lines starts at a respective corner of the plurality of corners and extends towards the top intersection point; and a front panel extending downwards from the first side of the plurality of sides of the top panel, the front panel having a third folding line, a fourth folding line, a fifth folding line, a sixth folding line, a seventh folding line, an eighth folding line, a ninth folding line, a first severance line, and a second severance line;

wherein the third folding line of the front panel extends from a meeting point of the second folding line with the first side of the plurality of sides of the top panel to a first point of the front panel that is away from a second side of the front panel which is opposite to the first side of the plurality of sides of the top panel;

wherein the fourth folding line of the front panel extends from a first edge of the second side of the front panel to the first point of the front panel;

wherein the fifth folding line of the front panel extends from a second edge of the second side of the front panel to the first point of the front panel;

wherein the first severance line of the front panel extends from a second point that is between the first point and the meeting point of the second folding line with the first side of the plurality of sides of the top panel, the first severance line extending at an upward angle towards a third side of the front panel that extends between the first side of the plurality of sides of the top panel and the second side of the front panel to a third point that is on the front panel and not on the third side;

wherein the second severance line of the front panel extends from the second point, the second severance line extending at an upward angle towards a fourth side of the front panel that extends between the first side of the plurality of sides of the top panel and the second side of the front panel to a fourth point that is on the front panel and not of the fourth side;

wherein the sixth folding line extends from the first point on the front panel to the third point;

wherein the seventh folding line extends from the first point on the front panel to the fourth point;

wherein the eighth folding line extends from the third point to a first proximal edge of the first side of the plurality of sides of the top panel;

wherein the ninth folding line extends from the fourth point to a second proximal edge of the first side of the plurality of sides of the top panel; and wherein a deltoid shape confined within the first severance line, the second severance line, the sixth folding line of the front panel, and the seventh folding line of the front panel forms the integrated pouring spout of the container.

14. The blank of claim 13, further comprising:

a plurality of side panels, each of the plurality of side panels extending from one of the plurality of sides of the top panel other than the first side of the plurality of sides of the top panel such that, together with the top panel and the front panel, the plurality of side panels collectively form a container when each of the folding lines is folded.

15. The blank of claim 13, wherein the second folding line of the top panel extends from essentially the center of the first side of the plurality of sides of the top panel.

16. The blank of claim 13, wherein the second folding line of the top panel is perpendicular to the first side of the plurality of sides of the top panel.

17. The blank of claim 13, wherein the third folding line of the front panel is perpendicular to the first side of the plurality of sides of the top panel.

18. The blank of claim 13, wherein the blank is adapted to contain therein at least one of: liquid, gel, powder, granular solids, and foodstuff.

19. The blank of claim 13, further comprising:

at least one window, wherein each window is defined in one of the plurality of side panels.

20. The blank of claim 19, wherein each window is covered with at least a partially transparent film.

21. The blank of claim 13, wherein the blank is made of any one of: a porous material and a non-porous material.

22. The blank of claim 13, wherein at least one of the panels is laminated.

23. The blank of claim 14, further comprising:

a plurality of flaps adapted to form a bottom of the container and extending from each of the plurality of side panels.

* * * * *